US008448818B2

(12) United States Patent
Ikushima

(10) Patent No.: US 8,448,818 B2
(45) Date of Patent: May 28, 2013

(54) DROP FORMING DISCHARGE DEVICE HAVING COLLISION MEMBER AND METHOD OF USING SAME

(75) Inventor: Kazumasa Ikushima, Mitaka (JP)

(73) Assignee: Musashi Engineering, Inc., Mitaika-shi, Tokyo (JP)

( * ) Notice: Subject to any disclaimer, the term of this patent is extended or adjusted under 35 U.S.C. 154(b) by 654 days.

(21) Appl. No.: 12/594,115

(22) PCT Filed: Mar. 28, 2008

(86) PCT No.: PCT/JP2008/000787

§ 371 (c)(1),
(2), (4) Date: Feb. 4, 2010

(87) PCT Pub. No.: WO2008/126373

PCT Pub. Date: Oct. 23, 2008

(65) Prior Publication Data

US 2010/0294810 A1 Nov. 25, 2010

(30) Foreign Application Priority Data

Mar. 30, 2007 (JP) ..... 2007-094672

(51) Int. Cl.
*B65D 47/18* (2006.01)
*B67D 3/00* (2006.01)

(52) U.S. Cl.
USPC ..... 222/1; 222/420; 222/181.1; 222/262; 222/336; 222/394; 222/504

(58) Field of Classification Search
USPC ..... 222/180, 181.1, 181.2, 181.3, 253, 222/262, 263, 336, 341, 409, 504, 559, 420, 222/571
See application file for complete search history.

(56) References Cited

U.S. PATENT DOCUMENTS 3,160,331 A * 12/1964 Trumbull et al. ..... 222/309
3,661,304 A * 5/1972 Martinez et al. ..... 222/394

(Continued)

FOREIGN PATENT DOCUMENTS

JP 8-206562 A 8/1996
JP 10-277457 A 10/1998

(Continued)

OTHER PUBLICATIONS

International Search Report of PCT/JP2008/000787, date of mailing May 20, 2008.

*Primary Examiner* — Kevin P Shaver
*Assistant Examiner* — Patrick M Buechner
(74) *Attorney, Agent, or Firm* — Westerman, Hattori, Daniels & Adrian, LLP

(57) ABSTRACT

The liquid material discharge device and method discharges a liquid droplet even under a condition where discharge of a small amount of liquid material is required. The apparatus has a liquid chamber having the discharge opening through which the liquid material is discharged, an extrusion member having a plunger and a contact portion, the plunger being thinner than the liquid chamber not to contact a side wall of the liquid chamber and having a forward end portion which advances and retracts within the liquid chamber, and a collision member disposed adjacent to the extrusion member on the side opposite to the plunger and having a piston and a collision portion facing the contact portion. The collision portion collides against the contact portion such that the extrusion member is advanced at a high speed to discharge the liquid material.

19 Claims, 9 Drawing Sheets

U.S. PATENT DOCUMENTS

| | | | | |
|---|---|---|---|---|
| 4,852,773 | A * | 8/1989 | Standlick et al. | 222/504 |
| 5,320,250 | A * | 6/1994 | La et al. | 222/1 |
| 5,375,738 | A | 12/1994 | Walsh et al. | |
| 5,535,919 | A | 7/1996 | Ganzer et al. | |
| 5,747,102 | A | 5/1998 | Smith et al. | |
| 5,913,455 | A * | 6/1999 | La et al. | 222/55 |
| 6,253,957 | B1 | 7/2001 | Messerly et al. | |
| 6,267,266 | B1 | 7/2001 | Smith et al. | |
| 7,134,617 | B2 * | 11/2006 | Ikushima | 239/584 |
| 2004/0134996 | A1 * | 7/2004 | Kazumasa | 239/11 |
| 2009/0101669 | A1 * | 4/2009 | Hassler et al. | 222/1 |
| 2010/0156970 | A1 * | 6/2010 | Ikushima | 347/8 |

FOREIGN PATENT DOCUMENTS

| | | | |
|---|---|---|---|
| JP | 2001-500962 | A | 1/2001 |
| JP | 2004-225666 | A | 8/2004 |
| JP | 2006-281178 | A | 10/2006 |
| WO | WO 2008108097 | A1 * | 9/2008 |

* cited by examiner

PRIOR ART

DROP FORMING DISCHARGE DEVICE HAVING COLLISION MEMBER AND METHOD OF USING SAME

TECHNICAL FIELD

The present invention relates to a technique for discharging a liquid material in a liquid chamber, which has a discharge opening, in a state of a liquid droplet from the discharge opening by advancing an extrusion member at a high speed.

In this description, the term "state of a liquid droplet" means a state where the discharged liquid material exists in air without contacting with the discharge opening and a work, and the liquid droplet is preferably in a spherical or droplet form. However, the form of the liquid droplet is not limited to such a preferable example, and it may be any of other suitable shapes.

BACKGROUND ART

As one of devices known in the technical field of this application, Patent Document 1, for example, discloses a device in which a liquid is discharged in a state of a liquid droplet from a discharge opening of a liquid chamber by quickly advancing a plunger toward the discharge opening and then abruptly stopping the plunger in the liquid chamber having the discharge opening.

In that type of known liquid material discharge device illustrated in FIG. 5, a piston is fixed to a rear end of a plunger such that the piston is biased forwards by a spring from the rear side. A part of a liquid material in a liquid chamber is discharged in a state of a liquid droplet from a discharge opening by supplying air to an inner space of a piston chamber forward of the piston so as to retract the piston together with the plunger, and then by releasing the air present forward of the piston to the atmosphere so as to advance the plunger. The plunger is stopped upon contacting with an inner wall of the liquid chamber, which is positioned forward of the plunger.

In the above known device, because the plunger advances in such a state that a circumferential surface of its forward end portion is held in non-contact with the inner wall of the liquid chamber, a part of the liquid material is allowed to move rearwards through a gap between the plunger and the liquid chamber. Therefore, resistance is small when the plunger is advanced, and the plunger can be smoothly advanced at a high speed.

Also, as a device differing in the principle of discharge, Patent Document 2, for example, discloses an applying device in which a liquid material is extruded by advancing a plunger which slides in a closely contact relation within a metering tube supplied with the liquid material. In such an applying device, the plunger is advanced by a piston rod which advances with the aid of an air piston chamber provided above the plunger and which strikes against an upper end of the plunger.

Patent Document 1: PCT Japanese Translation Patent Publication No. 2001-500962

Patent Document 2: Japanese Patent Laid-Open Publication No. 2004-225666

DISCLOSURE OF THE INVENTION

Problems to be Solved by the Invention

When trying to reduce an amount of the liquid material discharged in the state of a liquid droplet in the known liquid material device, it is required to shorten the distance through which the plunger is advanced. However, when the distance of advance of the plunger is reduced, a difficulty is caused in accelerating the plunger to a sufficient speed. This results in the problems that the liquid material cannot be discharged in the state of a liquid droplet, and that, even though the liquid material can be discharged in the state of a liquid droplet, the discharged liquid droplet cannot fly out as per the intended path.

The device disclosed in Patent Document 2 is constructed such that the plunger advances in a close-contact sliding relation to a lateral surface of the liquid chamber, and it is intended to discharge the liquid material while metering an amount of the liquid material. Thus, because the plunger advances in a close-contact sliding relation to the lateral surface of the liquid chamber, the liquid material can be precisely discharged in amount corresponding to the distance through which the plunger is moved. On other hand, there is a limit in moving the plunger at a higher speed for the reasons that a lateral surface of the plunger is held in contact with the inner wall of the liquid chamber when the plunger advances, and that the liquid material present forward of the plunger is required to be all moved forwards.

It is an object of the present invention to provide a liquid material discharge device and method capable of causing a liquid droplet to be satisfactorily discharged to fly out even under a condition where discharge of a small amount of liquid material is required.

Means for Solving the Problems

The inventor has succeeded in accelerating an extrusion member to a high speed through a short distance by causing a member, separate from the extrusion member, to collide against the extrusion member in a sufficiently accelerated state.

More specifically, according to a first invention, there is provided a liquid material discharge device comprising a liquid chamber having a discharge opening through which a liquid material is discharged, an extrusion member having a plunger thinner than the liquid chamber and a contact portion, the plunger having a forward end portion which advances and retracts within the liquid chamber, a collision member disposed adjacent to the extrusion member on the side opposite to the plunger and having a piston and a collision portion facing the contact portion, and driving means for advancing and retracting the extrusion member and the collision member, wherein the collision portion is collided against the contact portion such that the extrusion member is advanced at a high speed to discharge the liquid material.

According to a second invention, in the first invention, a distance through which the collision member is moved until the collision portion collides against the contact portion is set to be longer than a distance through which the extrusion member is moved until reaching a foremost advanced position thereof after the collision portion has collided against the contact portion.

According to a third invention, in the first or second invention, the driving means includes a resilient member for biasing the collision member in an advancing direction.

According to a fourth invention, the liquid material discharge device according to any one of the first to third inventions further comprises retracted position specifying means for specifying a rearmost retracted position of the extrusion member.

According to a fifth invention, in the fourth invention, the retracted position specifying means comprises a rear stopper for specifying a position of the extrusion member in a retracting direction of the extrusion member, and extrusion member biasing means for biasing the extrusion member rearwards.

According to a sixth invention, the liquid material discharge device according to any one of the first to fifth inventions further comprises advanced position specifying means for specifying a foremost advanced position of the extrusion member.

According to a seventh invention, in the sixth invention, the advanced position specifying means is constituted by an advance stopper with which the extrusion member comes into contact at a forward side thereof According to an eighth invention, in the sixth or seventh invention, the advanced position specifying means is constituted by an inner wall of the liquid chamber, the inner wall being located at a position toward which the forward end portion of the plunger advances.

According to a ninth invention, in any one of the sixth to eighth inventions, when the liquid material is not discharged, the extrusion member is pressed by the collision member and the extrusion member is held at the foremost advanced position thereof.

According to a tenth invention, in the eighth or ninth invention, the forward end portion of the plunger is formed to be able to cut off communication between the liquid chamber and the discharge opening.

According to an eleventh invention, in any one of the first to tenth inventions, the driving means includes an air supply device and a solenoid selector valve, and the extrusion member is biased in a retracting direction by air.

According to a twelfth invention, there is provided a liquid droplet discharge method for discharging a part of a liquid material in a liquid chamber in a state of a liquid droplet from a discharge opening by advancing an extrusion member at a high speed, the method comprising a step of arranging the liquid chamber having the discharge opening through which the liquid material is discharged, the extrusion member having a plunger thinner than the liquid chamber and a contact portion, the plunger having a forward end portion which advances and retracts within the liquid chamber, and a collision member disposed adjacent to the extrusion member on the side opposite to the plunger and having a piston and a collision portion facing the contact portion, and a step of colliding the collision portion against the contact portion such that the extrusion member is advanced at a high speed to discharge the liquid material.

According to a thirteenth invention, in the twelfth invention, a distance through which the collision member is moved until the collision portion collides against the contact portion is set to be longer than a distance through which the extrusion member is moved until reaching a foremost advanced position thereof after the collision portion has collided against the contact portion.

According to a fourteenth invention, in the twelfth or thirteenth invention, a standby position of the extrusion member is held the same for each discharge when the collision portion collides against the contact portion.

According to a fifteenth invention, in any one of the twelfth to fourteenth inventions, a foremost advanced position of the extrusion member is held the same for each discharge.

According to a sixteenth invention, in any one of the twelfth to fifteenth inventions, the collision portion is collided against the contact portion in a state of the collision member being accelerated.

According to a seventeenth invention, in any one of the twelfth to sixteenth inventions, the extrusion member is biased in a retracting direction such that, after end of the discharge, the collision member and the extrusion member are retracted in a state that the contact portion and the collision portion are in contact with each other.

According to an eighteenth invention, in any one of the twelfth to seventeenth inventions, the collision member is biased in an advancing direction such that, when the liquid material is not discharged, the collision member presses the extrusion member to maintain the extrusion member at a foremost advanced position thereof, thereby preventing the liquid material from leaking through the discharge opening.

Effect of the Invention

With the present invention, even when the distance through which the extrusion member advances is restricted, the liquid material can be satisfactorily discharged to fly out in the state of a liquid droplet.

Also, even a very small amount of liquid material can be discharged in the state of a liquid droplet.

DESCRIPTION OF REFERENCE CHARACTERS

Figure 1:
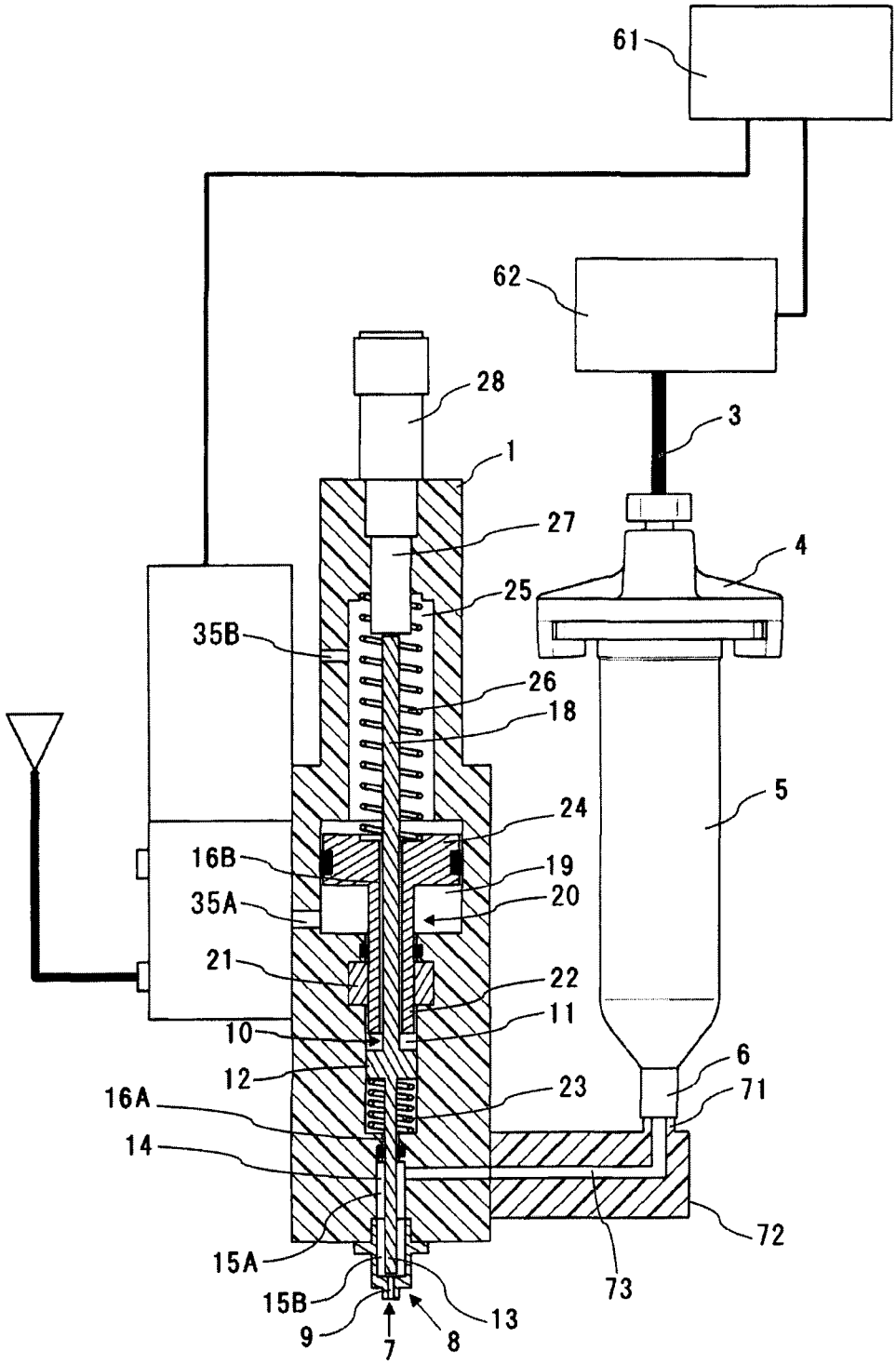
FIG. 1 represents an external appearance view and a sectional view of principal part of a liquid material discharge device according to Embodiment 1.

A legend of main reference characters used in the drawings is as follows:

1 main body/3 air tube/4 adapter/5 syringe/6 syringe discharge opening/7 discharge opening/8 nozzle/9 discharge flow passage 10/extrusion member/11 cylinder/12 contact portion/13 plunger/14 liquid chamber/15A, 15B, 15C, 15C recesses/16A, 16B, 16C through-holes/17A, 17B, 17C, 17D seals/18 rear contact member/19 piston chamber/20 collision member/21 guide/22 collision portion/23 spring/24 piston/25 spring chamber/26 spring/27 rear stopper/28 micrometer/30 fore stopper moving member/31 fore projection/32 rotation thumb/33 rear projection/35A, 35B, 35C air passages/41 driver-side main body/42 nozzle-side main body/43 base plate/51 solenoid selector valve/52 air supply source/53A, 53B ports/61 control unit/62 air supply device/71 syringe attachment portion/72 syringe attachment member/73 liquid-material supply flow passage/80 rear stopper moving member/81 rotation thumb/82 through-hole/83 driver-side cylinder/84 nozzle-side cylinder

BEST MODE FOR CARRYING OUT THE INVENTION

In the best mode, a liquid droplet discharge device for discharging a liquid material in a state of a liquid droplet from a discharge opening includes a liquid chamber having the discharge opening through which the liquid material is discharged, an extrusion member reciprocating in advancing and retracting directions in a state that a forward end portion of the extrusion member and a portion near the forward end portion are held in non-contact with an inner wall of the liquid chamber, and a collision member reciprocating in the same directions as the reciprocating directions of the extrusion member, wherein the extrusion member is disposed to be advanced upon the collision member colliding against the extrusion member.

Preferably, the liquid material discharge device is constructed such that the collision member advances through a distance longer than a distance through which the extrusion member advances after the collision member has collided against the extrusion member. The reason is that the extrusion member can be momentarily advanced at a high speed by accelerating the collision member into a state having sufficient energy, and then colliding the collision member against the extrusion member. For example, when the collision member is advanced by the action of a resilient member, such as a spring, the extrusion member can be advanced at a high speed by retracting the collision member to contract the resilient member into a state having sufficient energy, and then colliding the collision member against the extrusion member.

Because the momentum of the collision member depends on the mass and the speed of the collision member, optimum design is preferably performed in consideration of such parameters as the distance through which the collision member can be retracted, the speed of the collision member, and a mass ratio of the collision member to the extrusion member. The collision member may be made of a material having a density larger than that of the extrusion member.

With the device in the best mode, therefore, even when the distance through which the extrusion member advances is short, the liquid material can be satisfactorily discharged in the state of a liquid droplet by advancing the extrusion member at a high speed. It is hence possible to realize the device which has a high degree of freedom in design, and which has a smaller size and a lower cost.

Preferably, the collision member is constructed so as to advance by the action of a resilient member, such as a spring. The reason is that, because the resilient member has a characteristic of giving a greater repulsive force as the resilient member is contracted to a larger extent, the resilient member is advantageous in providing a larger distance of retraction of the collision member than the case of using air, for example.

Preferably, the liquid material discharge device further includes a rear stopper with which the extrusion member comes into contact at the rearward side thereof, and biasing means for biasing the extrusion member rearwards. The reason is that discharge in a next cycle can be immediately started by quickly retracting the extrusion member after the advance of the extrusion member is stopped.

Further, the resilient member has a property of always acting on the collision member to bias it forwards such that the resilient member can spontaneously bias the collision member forwards, thus bringing the extrusion member to a foremost advanced position with no need of a special operation when the liquid chamber is not discharged. Accordingly, the liquid chamber can be prevented from leaking through the discharge opening.

Preferably, the collision member is constructed so as to collide against the extrusion member in a state where the resilient member is contracted, i.e., in a state before the resilient member returns to its natural state, thereby causing the collision member to collide in an accelerated state against the extrusion member. With such a construction, the extrusion member can be more effectively accelerated by advancing the extrusion member, together with the collision member, with the continued biasing of the resilient member even after the collision.

Preferably, the liquid material discharge device further includes collision position specifying means for specifying the position of the extrusion member when the collision member collides against the extrusion member. The reason is that the discharge in the state of the liquid droplet can be performed with higher reproducibility by setting a standby position of the extrusion member to be the same for each discharge when the collision member collides against the extrusion member.

Preferably, the liquid material discharge device further includes advance stop-position specifying means for specifying the position where the extrusion member is stopped after being advanced with the collision by the collision member. The reason is that the advance stop position of the extrusion member can be held the same for each discharge with the provision of the advance stop-position specifying means, and therefore the discharge in the state of the liquid droplet can be performed with higher reproducibility. For example, the stop position specifying means may be constituted by the inner wall of the liquid chamber with which the extrusion member comes into contact at the forward side thereof. Such a constitution is also effective in a point that the extrusion member cuts off communication between the liquid chamber and the discharge opening to mechanically separate the liquid material, thus enabling the liquid material to be reliably discharged in the state of the liquid droplet.

Preferably, when the liquid material is not discharged, the extrusion member is pressed by the collision member to be held at the foremost advanced position. The reason is that such an arrangement is able to prevent liquid leakage from leaking when the liquid material is not discharged. More preferably, the extrusion member cuts off the communication between the liquid chamber and the exterior via the discharge opening when the extrusion member comes into contact with the inner wall of the liquid chamber.

According to a liquid droplet discharge method In the best mode, in a liquid chamber having a discharge opening through which a liquid material is discharged, an extrusion member is advanced toward the discharge opening in a state that a forward end portion of the extrusion member and a portion near the forward end portion are held in non-contact with an inner wall of the liquid chamber, whereby a part of the liquid material in the liquid chamber is discharged in a state of a liquid droplet from the discharge opening.

For the reasons described above, preferably, the collision member advances through a distance longer than a distance through which the extrusion member advances after the collision member has collided against the extrusion member. The mass of the collision member is preferably equal to or larger than that of the extrusion member.

In addition, it is preferable to hold the standby position of the extrusion member to be the same for each discharge when the collision member collides against the extrusion member, to hold the stop position of the extrusion member after the advance to be the same for each discharge, and to bias the extrusion member rearwards after the stop of advance of the extrusion member such that the extrusion member and the collision member are retracted while the extrusion member and the collision member are maintained in contact with each other.

In the present invention, since a very small amount of liquid droplet is discharged to fly out, an influence of gravity is small. However, when a high level of accuracy is required, a discharge operation is performed with a nozzle directed downwards, more preferably with a nozzle directed vertically downwards.

Details of the present invention will be described below in connection with embodiments, but the present invention is in no way restricted by the following embodiments.

Embodiment 1

Construction

FIG. 1 represents an external appearance view and a sectional view of principal part of a device according to Embodiment 1. In the following, for the sake of explanation, the side closer to a nozzle 8 is called the "fore or forward side" and the side closer to a micrometer 28 is called the "rear or rearward side" depending on cases.

A main body 1 has a recess 15A which is a tubular space formed in its fore end, a small-diameter through-hole 16A formed rearward of the recess 15A, a cylinder 11 which is a space communicating with the through-hole 16A, a piston chamber 19 which is a space formed rearward of the cylinder 11 and having a diameter larger than that of the cylinder 11, and a spring chamber 25 which is a space formed rearward of the piston chamber 19 and having a diameter smaller than that of the piston chamber 19.

The nozzle 8 is fitted to the main body 1 to be communicated with the recess 15A. The nozzle 8 has a tubular recess 15B formed on the rearward end side thereof and a small-diameter discharge flow passage 9 formed on the fore end side thereof and communicating with the recess 15B. An opening formed at the fore end of discharge flow passage 9 serves as a discharge opening 7. A liquid chamber 14 is defined by the recess 15A and the recess 15B in a state where the nozzle 8 is fitted to the main body 1.

Inside the main body 1, an extrusion member 10 and a collision member 20 are arranged to be able to reciprocate in advancing and retracting directions.

The extrusion member 10 comprises a plunger 13 positioned on the forward side, a rear contact member 18 positioned on the rearward side, and a contact portion 12 connecting the plunger 13 and the rear contact member 18 to each other.

The plunger 13 is a slender columnar member having a small diameter and disposed forward of the extrusion member 10. The plunger 13 is arranged such that its fore end is positioned in the liquid chamber 14 and its rear end is positioned in the cylinder 11. While in this embodiment the fore end of the plunger 13 is formed flat, the fore end may be formed into a curved surface or may be provided with a projecting member.

A seal 17A is fitted to an inner wall of the through-hole 16A in a close contact relation to a lateral surface of the plunger 13. The seal 17A surrounds the plunger 13 in a sealing manner while allowing the plunger 13 to slide, thus cutting off communication between the liquid chamber 14 and the cylinder 11.

In the cylinder 11, a spring 23 is disposed with the plunger 13 penetrating through the coiled form of the spring 23. The spring 23 is arranged between a forward inner wall surface of the cylinder 11 and a fore end of the contact portion 12 so as to always bias the extrusion member 10 rearwards. With such a construction, in a state where the contact portion 12 and the collision member 20 are not in contact with each other, the extrusion member 10 is stopped in a state biased into contact with a rear stopper 27 (described later). The resiliency and the length of the spring 23 are preferably adjusted such that, when a collision portion 22 and the contact portion 12 are not in contact with each other, the extrusion member 10 can be biased by the spring 23 into a state contacting with the rear stopper 27.

Be it noted that the spring 23 may be arranged to bias some other suitable portion than the fore end of the contact portion 12 so long as the extrusion member can be biased rearwards by the spring 23.

The contact portion 12 having a larger diameter than the plunger 13 and having a columnar or disk-like shape is fixed to the rear end of the plunger 13. The contact portion 12 is slidably disposed within the cylinder 11. In this embodiment, the contact portion 12 slides within the cylinder 11 in a close contact relation to prevent the extrusion member 10 from wobbling laterally.

The rear contact member 18 having a smaller diameter than the contact portion 12 and having a columnar shape is fixed to a rear end of the contact portion 12. The rear contact member 18 penetrates through the coiled form of a spring 26 and extends up to near a rear end of the spring chamber 25.

The spring 26 biases the collision member 20 forwards. The resiliency and the length of the spring 26 are preferably adjusted such that, in a state where a space on the forward side of the piston chamber 19 is communicated with the atmosphere, the spring 26 can bias the extrusion member 10 to its advance stop position against the biasing of the spring 23.

The collision member 20 comprises the collision portion 22 positioned on the forward side and a piston 24 positioned on the rearward side. The collision member 20 has a through-hole 16B penetrating therethrough along a center axis thereof.

The collision portion 22 is a columnar portion having a diameter smaller than the cylinder 11 and coaxially disposed forward of the piston 24. A fore end of the collision portion 22 is positioned within the cylinder 11.

The cylinder 11 includes a seal 17C and a guide 21 disposed therein. The seal 17C surrounds the collision portion 22 in a sealing manner while allowing the collision portion 22 to slide in a close contact relation to the cylinder 11, thus cutting off communication between the cylinder 11 and a forward space of the piston chamber 19. The guide 21 slidably supports the collision portion 22 in a manner to prevent the collision portion 22 from wobbling laterally. While in this embodiment the guide 21 is made of a simple cylindrical member, bearings or the likes may be disposed in a portion of the guide 21 for the purpose of ensuring smoother sliding of the collision portion 22. The position and the number of the guide 21 are not limited to the illustrated ones. For example, the guide 21 may have the through-hole 16A penetrating therethrough to prevent the extrusion member from wobbling laterally.

The piston 24 is a cylindrical member and is disposed in the piston chamber 19 so as to divide the piston chamber 19 into a forward space and a rearward space. The piston 24 is provided on its lateral peripheral surface with a seal 17B which surrounds the piston 24 in a sealing manner while allowing the piston 24 to slide within the piston chamber 19 in a close contact state.

The through-hole 16B penetrates from a fore end of the collision portion 22 to a rear end of the piston 24. The rear contact member 18 of the extrusion member 10 is inserted in the through-hole 16B. The inner diameter of the through-hole 16B is set to be larger than the outer diameter of the rear contact member 18 such that the advancing and retracting operation of the extrusion member 10 is not impeded.

The piston chamber 19 is provided with an air passage 35A on its side. The air passage 35A is formed to establish communication between a side of the forward space in the piston chamber 19 and a solenoid selector valve 51 disposed externally of the main body 1.

The solenoid selector valve 51 has a port 53A communicating with an air supply source 52, and a port 53B opened to the atmosphere. The solenoid selector valve 51 can be selectively brought into a first state where the forward side of the piston chamber 19 and the air supply source 52 are communicated with each other, and a second state where the forward side of the piston chamber 19 and the atmosphere are communicated with each other.

The spring chamber 25 is provided on its side with an air passage 35B communicating with the exterior. The air passage 35B always communicates both the rearward space of the piston chamber 19 and the spring chamber 25 with the atmosphere.

The spring 26 is disposed between the rear end of the piston 24 and an inner wall surface of the spring chamber 25 on the rearward side thereof. The piston 24 is biased forwards by the spring 26.

A rear stopper 27 is disposed at a rear end of the main body 1 and projects into the spring chamber 25. The rear stopper 27 contacts with a rear end of the rear contact member 18, thereby limiting the rearward movement of the extrusion member 10. A rear end of the rear stopper 27 is coupled to a micrometer 28. The position of the rear stopper 27 in the back-and-forth direction can be adjusted by operating the micrometer 28.

While in this embodiment the rear contact member 18 coming into contact with the rear stopper 27 is disposed at the rear end of the extrusion member 10, the contact member 18 may be disposed at some other suitable position than the rear end of the extrusion member 10. As another arrangement disclosed herein, for example, a disk-like member is disposed midway the rear contact member 18 having a columnar shape, and the rear stopper 27 having a columnar shape is disposed at a position opposed to the disk-like member.

A syringe attachment member 72 is disposed at a side of the main body 1 in a forward portion thereof. The syringe attachment member 72 has a syringe attachment portion 71 which is connectable to a syringe discharge opening 6 of a syringe storing the liquid material. The syringe attachment member 72 has a liquid-material supply flow passage 73 formed therein. The liquid-material supply flow passage 73 has one end located in a lateral surface of the liquid chamber 14 near its rear end, and the other end located in the syringe attachment portion 71. A syringe 5 fitted to the syringe attachment portion 71 is communicated with the liquid chamber 14 by the liquid-material supply flow passage 73.

An air tube 3 is connected at its one end to a top of the syringe 5 through an adaptor 4, and the other end of the air tube 3 is connected to an air supply device 62. The air supply device 62 supplies air to the syringe 5 through the air tube 3 to establish a desired pressure in an inner space of the syringe 5, whereupon the liquid material in the syringe 5 is shifted into the liquid chamber 14.

The air supply device 62 and the solenoid selector valve 51 are connected to a control unit 61 such that the switching of the solenoid selector valve 51 and the supply of air into the syringe are controlled in accordance with signals from the control unit 61.

Operation

The operation of the device according to this embodiment will be described with reference to FIGS. 2*a* to 2*d*.

Figure 2A:
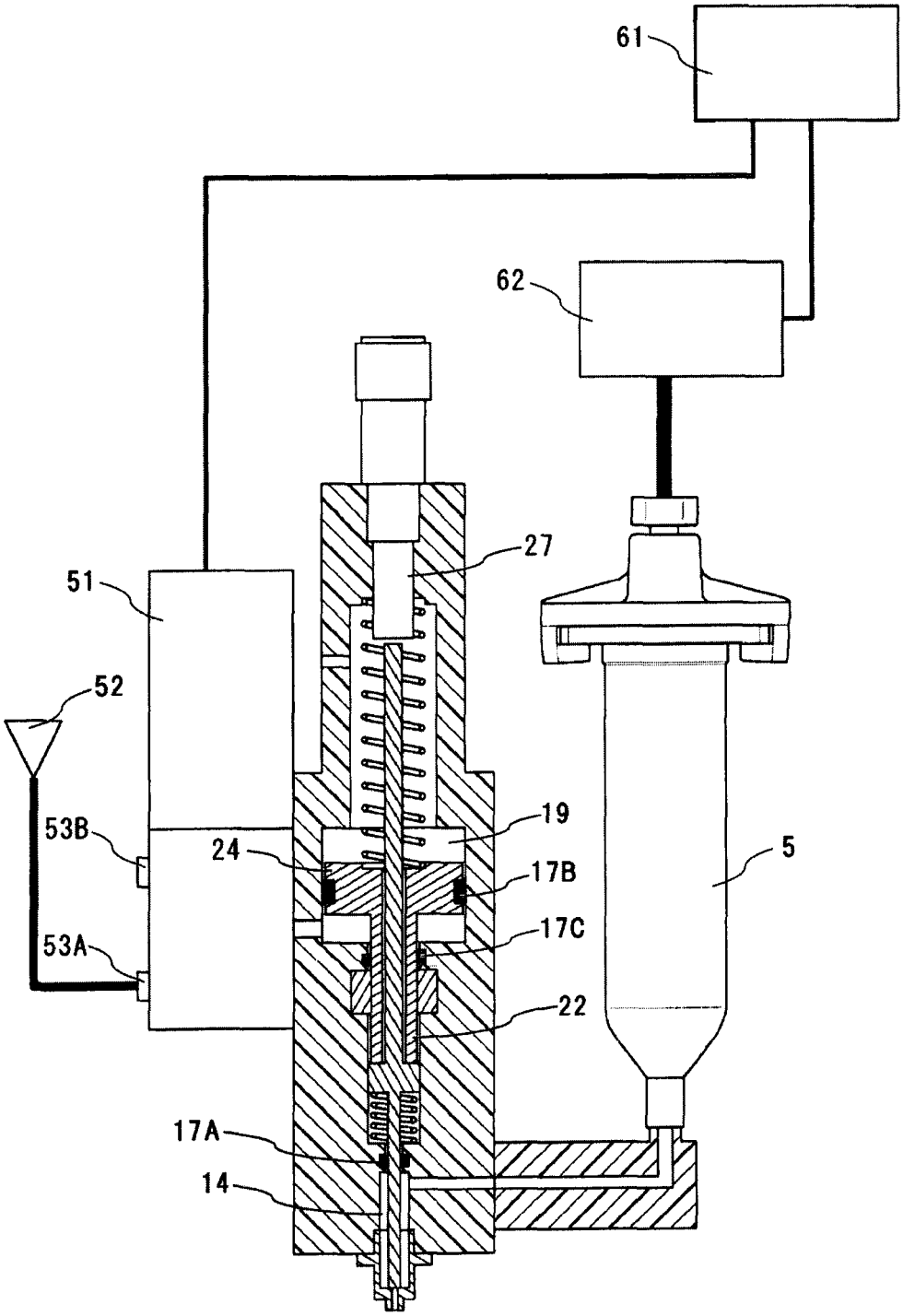
FIG. 2*a* is a sectional view (1/4) of principal part to explain a discharge operation in the liquid material discharge device according to Embodiment 1.

FIG. 2*a* illustrates a state before the discharge where the liquid material is filled in both the liquid-material supply flow passage 73 and the liquid chamber 14. In that state, the inner space of the syringe 5 is pressurized to the desired pressure by the air supply device 62 so that the liquid material is smoothly supplied from the syringe 5 to the liquid chamber 14. When the liquid material can be sufficiently supplied to the liquid chamber 14 with no need of pressurization, the pressurization by the air supply device 62 may be omitted.

The position of the rear stopper 27 is adjusted by moving the micrometer 28 forwards or rearwards. A standby position of the extrusion member 10 in a state where the collision portion 22 and the contact portion 12 are held in non-contact with each other is determined depending on the position of the rear stopper 27.

The solenoid selector valve 51 is in a state communicating the forward space of the piston chamber 19 and the port 53B with each other such that the forward space of the piston chamber 19 is communicated with the atmosphere. Therefore, the collision member 20 presses the contact portion 12 by the biasing of the spring 26. Because the biasing force of the spring 26 is stronger than that of the spring 23, the fore end of the plunger 13 is maintained in a state contacting with the inner wall of the liquid chamber 14. In that state, the fore end of the plunger 13 closes the discharge flow passage 9, and hence the liquid material in the liquid chamber 14 is prevented from leaking through the discharge opening 7.

Figure 2B:
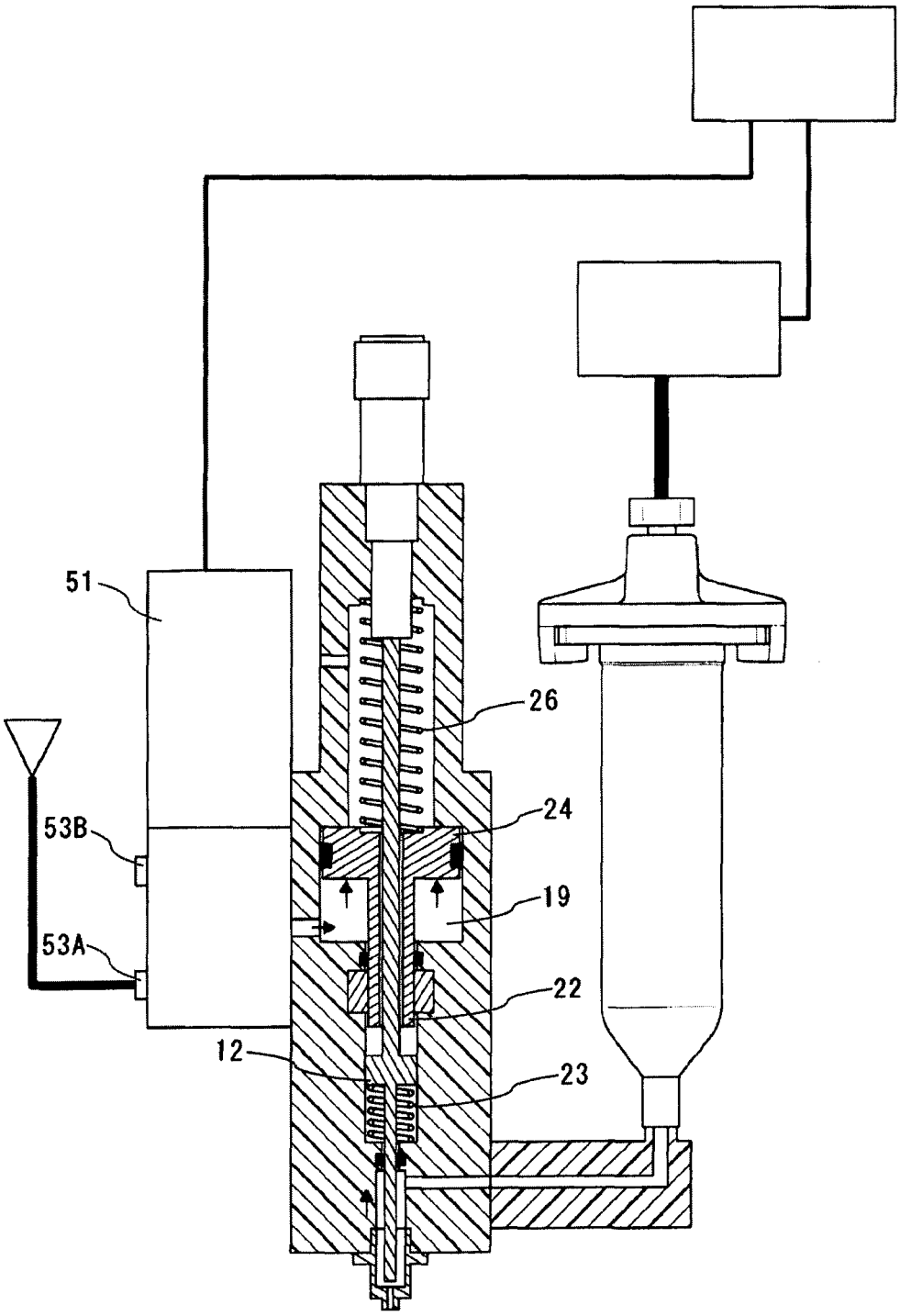
FIG. 2*b* is a sectional view (2/4) of principal part to explain the discharge operation in the liquid material discharge device according to Embodiment 1.

As illustrated in FIG. 2*b*, the piston chamber 19 is divided by the piston 24 into the forward space and the rearward space. The solenoid selector valve 51 is switched over to communicate the forward space of the piston chamber 19 with the port 53A, thus establishing a state where the forward space of the piston chamber 19 is communicated with the air supply source 52. When air is supplied from the air supply source 52 to the forward space of the piston chamber 19, the piston 24 receives a pressurizing force from the forward space of the piston chamber 19, whereupon the collision member 20 retracts against the biasing of the spring 26.

When the collision member 20 retracts, the extrusion member 10 also retracts while keeping a state where the contact portion 12 and the collision portion 22 are in contact with each other by the rearward biasing action of the spring 23. Upon the rear end of the rear contact member 18 contacting with the rear stopper 27, the extrusion member 10 stops the rearward movement and the rear contact member 18 is maintained in the state contacting with the rear stopper 27 by the action of the spring 23.

Even after the stop of the extrusion member 10, the collision member 20 continues to retract such that the collision portion 22 and the contact portion 12 are separated from each other and come into a non-contact state. The retraction of the collision member 20 continues until the rear end of the piston 24 comes into contact with the inner wall surface of the piston chamber 19 on the rearward side thereof. During a period in which air is supplied to the forward side of the piston chamber 19, the collision member 20 is maintained in the state contacting with the inner wall surface of the piston chamber 19 on the rearward side thereof.

Figure 2C:
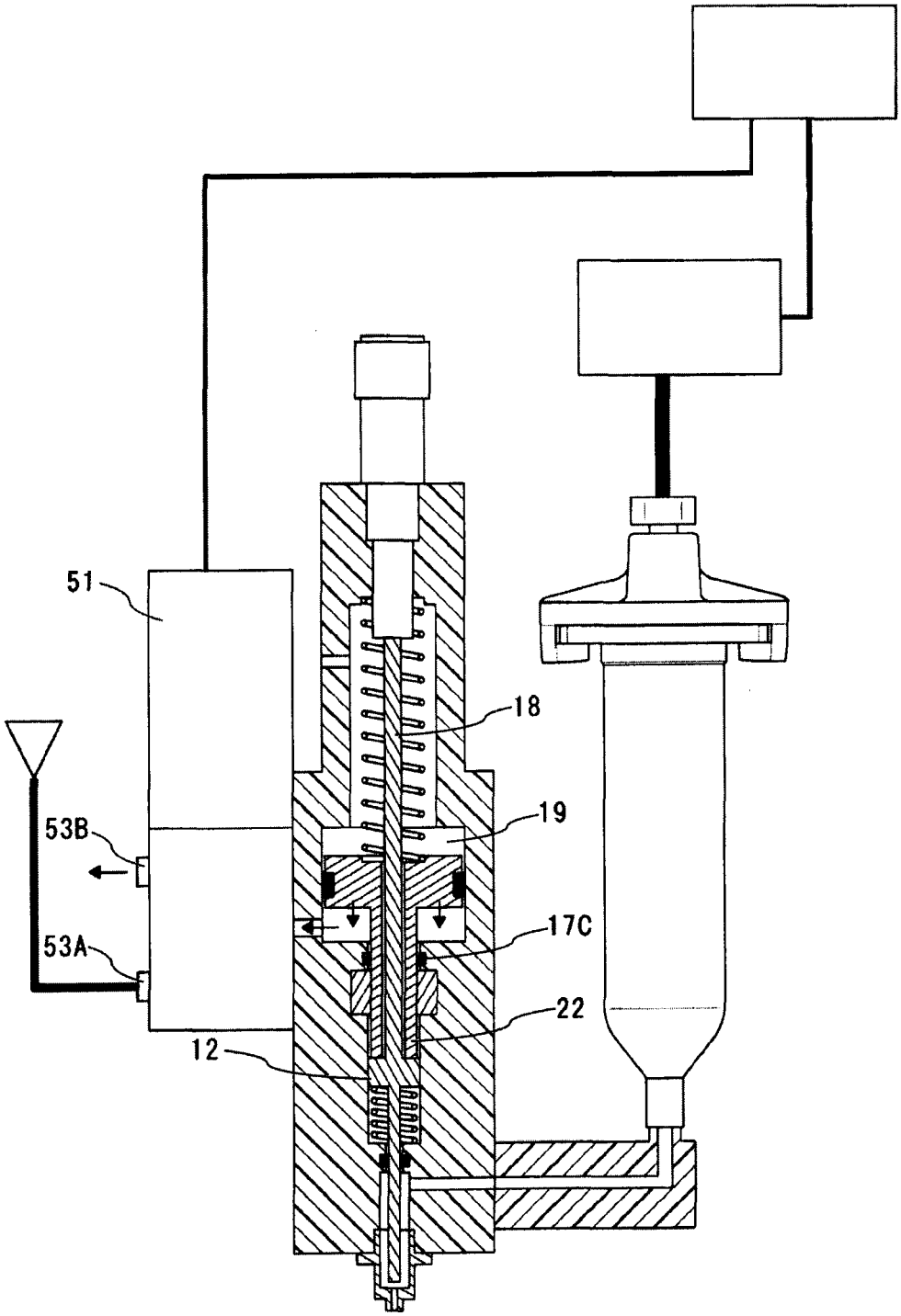
FIG. 2*c* is a sectional view (3/4) of principal part to explain the discharge operation in the liquid material discharge device according to Embodiment 1.

As illustrated in FIG. 2*c*, the solenoid selector valve 51 is switched over such that the forward space of the piston chamber 19 is communicated with the port 53B to establish the state where the forward space of the piston chamber 19 is communicated with the atmosphere. Upon the forward space of the piston chamber 19 being communicated with the atmosphere, the force acting to press the piston 24 rearwards is no longer present, and hence the collision member 20 is advanced forwards while being quickly accelerated by the biasing of the spring 26.

When the collision portion 22 of the collision member 20 collides against the rear end of the contact portion 12 of the extrusion member 10, the extrusion member 10 is momentarily accelerated to advance at a high speed by receiving energy of the collision member 20. On that occasion, the contact portion 12 is biased rearwards by the spring 23. However, since the collision member 20 has sufficient energy applied thereto, the extrusion member 10 can be momentarily accelerated against the biasing of the spring 23.

Figure 2D:
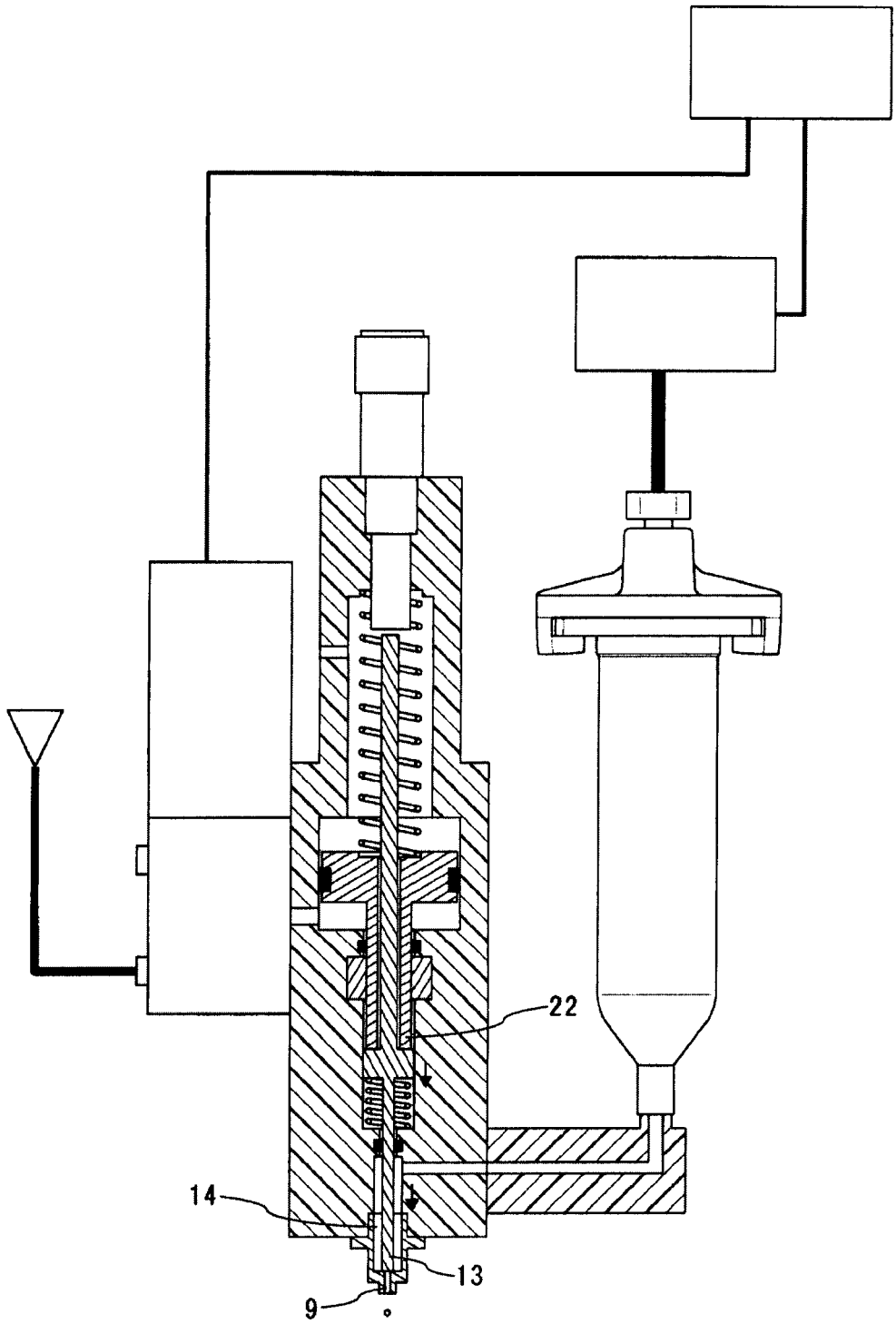
FIG. 2*d* is a sectional view (4/4) of principal part to explain the discharge operation in the liquid material discharge device according to Embodiment 1.

As illustrated in FIG. 2*d*, the extrusion member 10 pressed by the collision portion 22 stops its advance upon the fore end of the plunger 13 coming into contact with the inner wall of the liquid chamber 14. Upon the fore end of the plunger 13 coming into contact with the inner wall of the liquid chamber 14, the liquid material is mechanically separated and is discharged in the state of the liquid droplet.

The fore end of the plunger 13 is formed so as to close the discharge flow passage 9, and comes into contact with the inner wall of the liquid chamber 14 to cut off the communication between the interior of the liquid chamber 14 and the discharge flow passage 9. Hence, the liquid material can be satisfactorily separated.

Through the above-described steps, one cycle of discharge is completed. After the one cycle of discharge, the components are positioned in the state of FIG. 2*a* again. Second and subsequent cycles of discharge are performed by repeating the above-described operations.

According to the device of this embodiment which is constructed and operates as described above, since the collision member 20 having been accelerated to a sufficient speed is caused to collide against the extrusion member 10, the extrusion member 10 can be momentarily accelerated and advanced at a high speed even when the distance through which the extrusion member 10 advances is short. Therefore, a very small amount of liquid material can be satisfactorily discharged to fly out in the state of the liquid droplet.

Preferably, during the movement of the collision member 20 until colliding against the extrusion member 10, the collision member 20 is held in a state being accelerated at all times such that the collision member 20 collides against the extrusion member 10 at a higher speed. More preferably, the collision member 20 collides against the extrusion member 10 in a state under acceleration.

Further, by colliding the collision member against the extrusion member in a state where the length of the spring 26 is shorter than its natural length, the collision member can be caused in the still accelerated state to collide against the extrusion member. In other words, since the extrusion member is advanced together with the collision member by the biasing of the spring 26 just even after the collision, the extrusion member can be more effectively accelerated.

Preferably, the collision member 20 is sufficiently accelerated by setting the distance of advance of the collision member 20 to be longer than that of the extrusion member 10. In the device of this embodiment, in the state where the collision member 20 is in contact with the inner wall surface of the piston chamber 19 on the rearward side thereof and the extrusion member 10 is in contact with the rear stopper 27, the distance from the fore end of the collision portion 22 to the rear end of the contact portion 12 is set to be longer than the distance from the fore end of the plunger 13 of the extrusion member 10 to the inner wall of the liquid chamber 14 forward of the fore end of the plunger 13. With such an arrangement, the collision member 20 can be caused to advance through the distance longer than the distance through which the extrusion member 10 advances after the collision member 20 has collided against the extrusion member 10.

Further, in the device of this embodiment, the distance from the fore end of the collision portion 22 to the rear end of the contact portion 12 and the distance from the fore end of the plunger 13 of the extrusion member 10 to the inner wall of the liquid chamber 14 forward of the fore end of the plunger 13 can be each changed by adjusting the position of the rear stopper 27 in the back-and-forth direction. The device is preferably constructed such that the position of the rear stopper 27 in the back-and-forth direction can be adjusted to a position where the distance from the fore end of the collision portion 22 to the rear end of the contact portion 12 is longer than the distance from the fore end of the plunger 13 of the extrusion member 10 to the inner wall of the liquid chamber 14 forward of the fore end of the plunger 13.

In spite of including two reciprocating members, i.e., the extrusion member 10 and the collision member 20, the device of this embodiment can be operated just by switching over one solenoid selector valve 51 similarly to the known device. Because of no need of a new additional driving source, the known device can be easily modified to the device of this embodiment.

Moreover, the plunger 13 is formed to be thinner than the liquid chamber 14 and its forward end portion is always held in non-contact with the inner wall of the liquid chamber 14. With such a construction, the liquid material in the liquid chamber 14 is not all extruded forwards by the advance of the plunger 13, and a part of the liquid material is moved rearwards through a gap between the plunger 13 and the liquid chamber 14. Accordingly, resistance is small when the plunger 13 is advanced, and the plunger 13 can be smoothly advanced at a high speed to discharge the liquid material. In addition, since the liquid material is smoothly moved within the liquid chamber 14, the liquid material can be quickly replenished to the liquid chamber 14 from the syringe 5.

Embodiment 2

Construction

A device of Embodiment 2 differs from the device of Embodiment 1 in that the extrusion member 10 is moved rearwards by utilizing air pressure.

Figure 3:
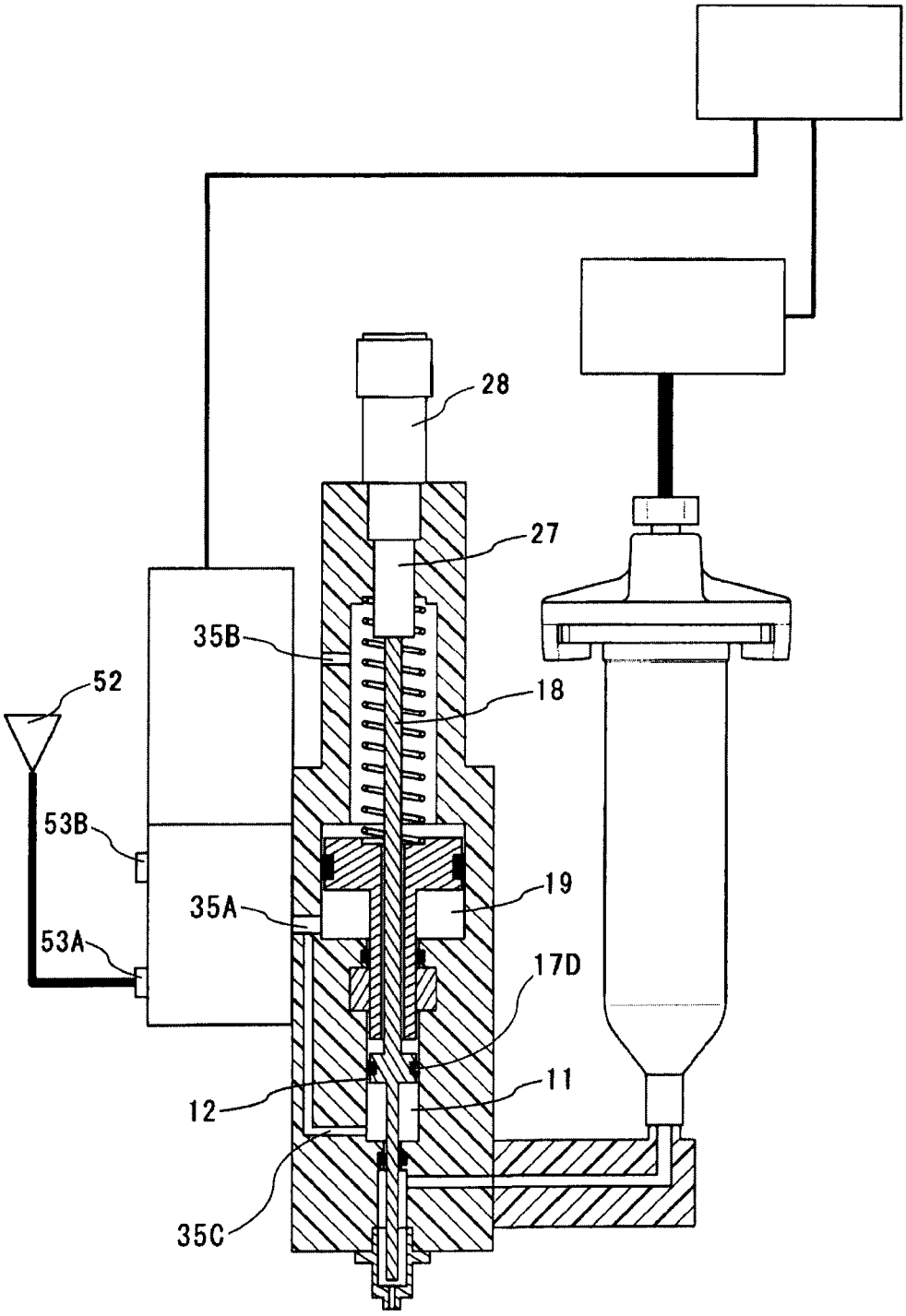
FIG. 3 represents an external appearance view and a sectional view of principal part of a liquid material discharge device according to Embodiment 2.

As illustrated in FIG. 3, the contact portion 12 divides the cylinder 11 into a forward space and a rearward space. A seal 17D is disposed on a circumferential surface of the contact portion 12 to surround the contact portion 12 in a sealing way while allowing the contact portion 12 to slide in a close contact state with respect to the piston chamber 19.

An air passage 35C is branched from the air passage 35A. The air passage 35C is communicated with the forward space of the cylinder 11, which is divided by the contact portion 12. The extrusion member 10 can be advanced and retracted by changing the pressure in the forward space of the cylinder 11.

The other construction is similar to that in the device of Embodiment 1.

Operation

When the solenoid selector valve 51 is switched over to communicate the air passage 35A and the port 53A with each other, air from the air supply source 52 is supplied to the forward space of the piston chamber 19 through the air passage 35A and is also supplied to the forward space of the cylinder 11 through the air passage 35C.

The extrusion member 10 starts to retract upon air being supplied through the air passage 35C, and the retraction of the extrusion member 10 is stopped upon the rear end of the rear contact member 18 contacting with the rear stopper 27. Even after the stop, the extrusion member 10 is maintained in the state held in contact with the rear stopper 27 by the presence of air supplied to the forward space of the cylinder 11.

The collision member 20 also starts to retract upon air being supplied through the air passage 35A and continues to retract even after the stop of the extrusion member 10. The collision member 20 is caused to retract until the rear end of the piston 24 comes into contact with the inner wall surface of the piston chamber 19 on the rearward side thereof. The collision member 20 is maintained in the state held in contact with the rear stopper by the presence of air supplied to the forward space of the piston chamber 19.

Next, when the solenoid selector valve 51 is switched over to communicate the air port 35A and the port 53B with each other, not only the air in the forward space of the piston chamber 19, but also the air in the forward space of the cylinder 11 are purged out. As a result, the force imposed from the air in the forward space of the piston chamber 19 to press the collision member 20 rearwards is so reduced that the collision member 20 is moved forwards while being quickly accelerated by the force of the spring 26 acting to press the collision member 20 forwards. Since the biasing force of the spring 26 is set to be sufficiently strong and the distance of advance of the collision member 20 is set to a sufficient value, the extrusion member 10 is momentarily accelerated to a speed enough to discharge the liquid material upon the collision portion 22 colliding against the contact portion 12. In the device of this embodiment, since the force acting to press the contact portion 12 rearwards can be reduced to substantially zero by communicating the forward space of the cylinder 11 with the atmosphere, the extrusion member 10 can be more quickly accelerated than in the device of Embodiment 1.

Similarly to the device of Embodiment 1, the device of this embodiment can also be operated just by switching over one solenoid selector valve 51. Because of no need of a new additional driving source, the known device can be easily modified to the device of this embodiment.

Although the device construction becomes more complicated, the air supply source 52 and the solenoid selector valve 51 may be provided for each of the forward space of the piston chamber 19 and the forward space of the cylinder 11 such that the air in the forward space of the piston chamber 19 and the air in the forward space of the cylinder 11 are adjusted independently of each other.

While in the device of this embodiment the collision member 20 is biased by the spring disposed on the rearward side and the extrusion member 10 is biased by the action of air applied from the forward side, the present invention is not limited to such an arrangement. As other arrangements disclosed herein, for example, the device may be constructed so as to bias both the collision member 20 and the extrusion member 10 by the action of air, or to bias both or one of them by utilizing an electromagnetic force or a piezoelectric substance, or by utilizing a ball screw driven by, e.g., a motor.

Further, while the retracted position of the collision member 20 is specified by the piston coming into contact with the inner wall of the piston chamber 19 on the rearward side thereof, the present invention is not limited to such an arrangement. For example, a stopper for the collision member 20 may be provided on the inner wall of the piston chamber 19 on the rearward side thereof to make the retracted position of the collision member 20 adjustable.

Embodiment 3

Construction

A device of Embodiment 3 differs from the devices of the other embodiments in that the position at which the advance of the extrusion member 10 is stopped (i.e., the foremost advanced position) can be specified.

Figure 4:
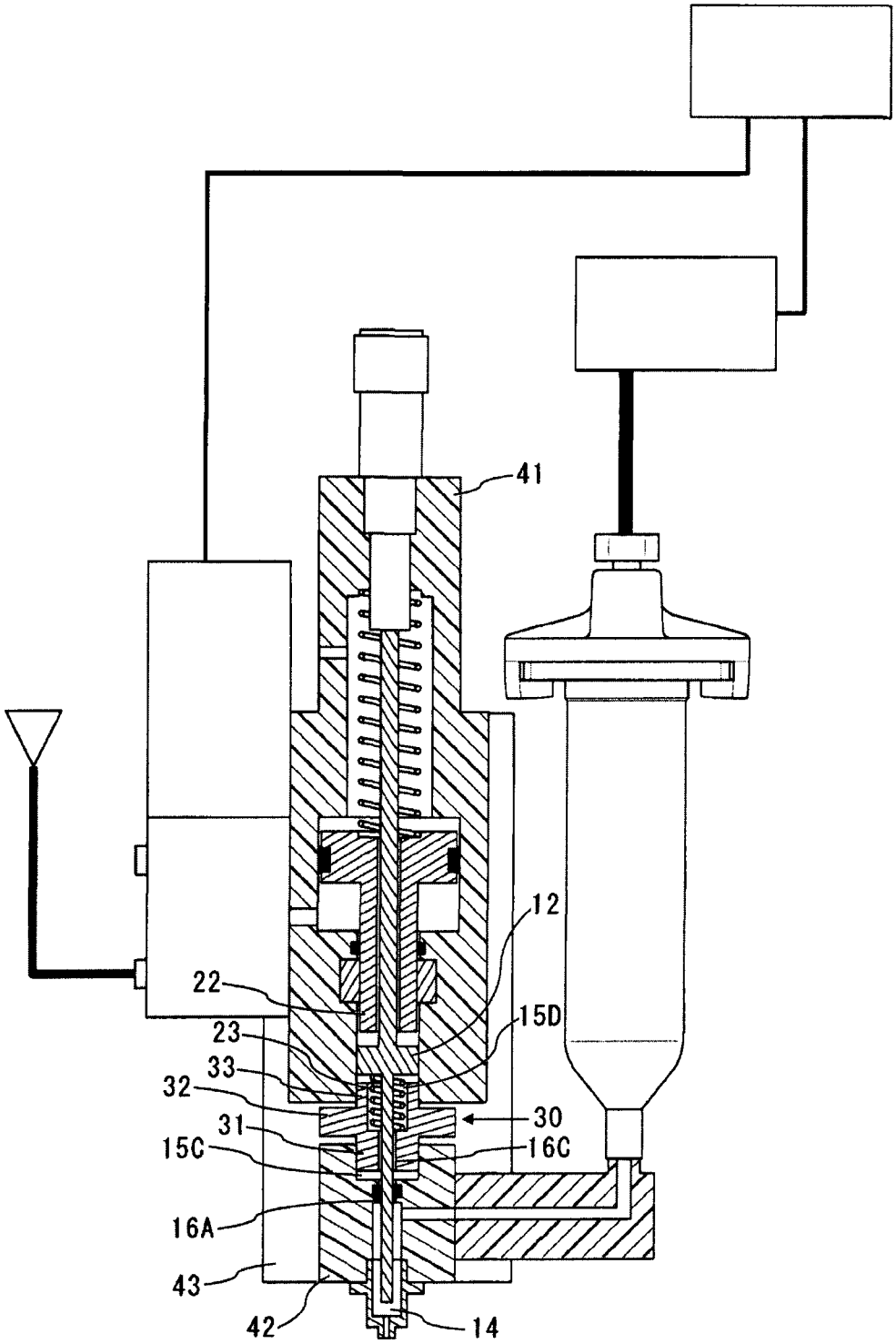
FIG. 4 represents an external appearance view and a sectional view of principal part of a liquid material discharge device according to Embodiment 3.
Figure 5:
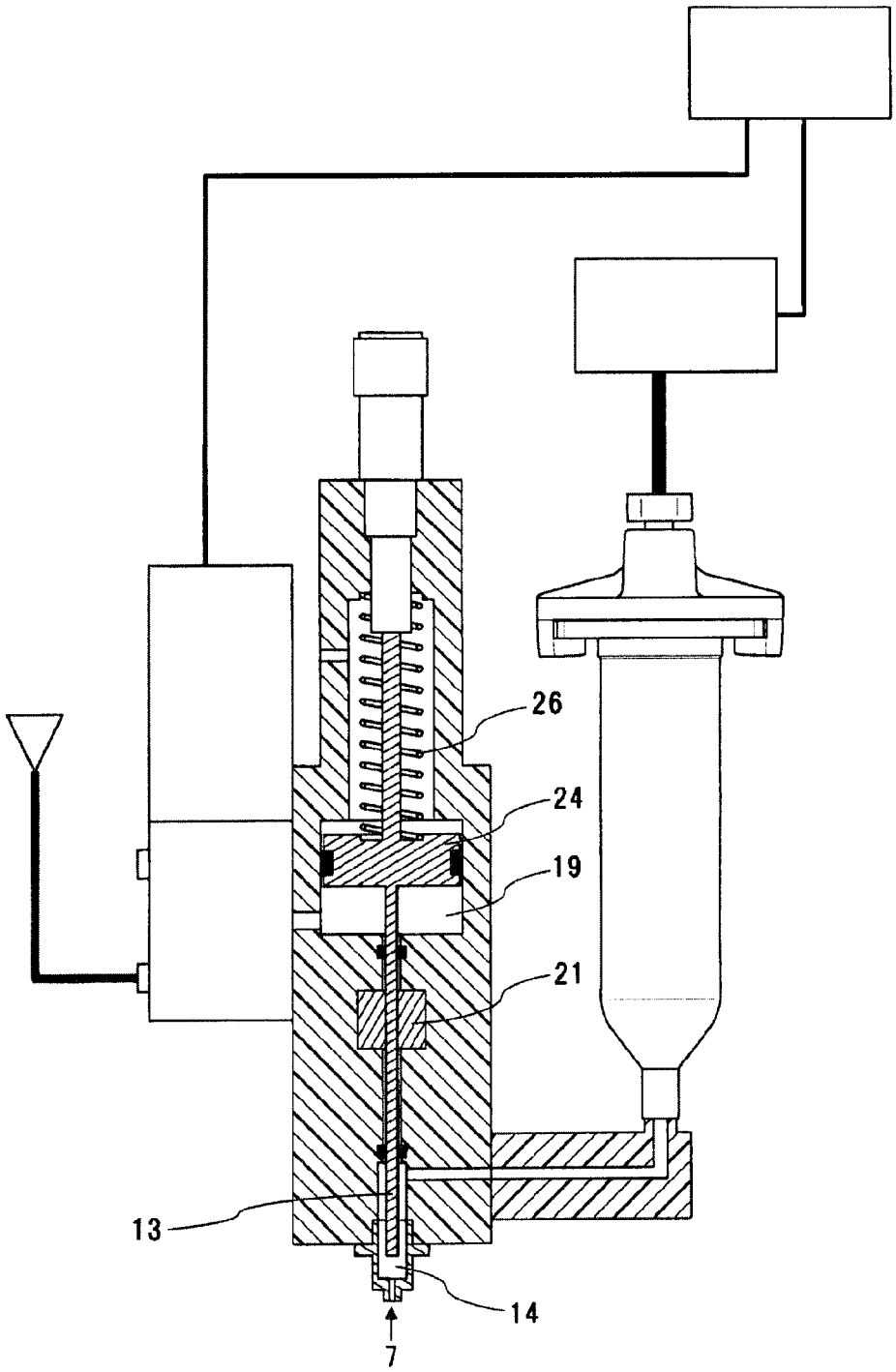
FIG. 5 represents an external appearance view and a sectional view of principal part of a known liquid material discharge device.

As illustrated in FIG. 4, the device of this embodiment is featured in comprising a driver-side main body 41, a nozzle-side main body 42, and a fore stopper moving member 30 positioned between them.

The driver-side main body 41 includes the cylinder 11, the piston chamber 19, and the spring chamber 25, whereas the nozzle-side main body 42 includes the liquid chamber 14, a recess 15C, and the through-hole 16A.

The driver-side main body 41 and the nozzle-side main body 42 are fixed to a base plate 43 such that the relative positional relationship between them is not changed.

The fore stopper moving member 30 is disposed between the driver-side main body 41 and the nozzle-side main body 42, and it serves to specify the foremost advanced position of the extrusion member 10. The fore stopper moving member 30 comprises a disk-shaped rotation thumb 32, a columnar fore projection 31 provided forward of the rotation thumb 32, and a columnar rear projection 33 provided rearward of the rotation thumb.

The fore projection 31 has threads formed on its outer circumferential surface and is screwed into the recess 15C of the nozzle-side main body 41, which also has threads formed on its inner surface. The rear projection 32 is formed to have the same diameter as the inner diameter of the cylinder 11 in the driver-side main body 42, and it is inserted in the cylinder 11.

A recess 15D is formed at a rear end of the fore stopper moving member 30, and a through-hole 16C is formed so as to penetrate the fore stopper moving member 30 from its foremost end to the recess 15D.

The plunger 13 is inserted to pass through both the recess 15D and the through-hole 16C. The inner diameter of the through-hole 16C is set to be larger than the outer diameter of the plunger 13 of the extrusion member 10 such that the advance of the plunger 13 is not impeded.

The spring 23 is inserted in the recess 15D formed in the fore stopper moving member 30 on the rearward side thereof and is held in contact with the fore end surface of the contact portion 12, thus biasing the extrusion member 10 rearwards.

The foremost advanced position of the extrusion member 10 can be specified by adjusting the position of the fore stopper moving member 30. The reason is that the position where the advance of the extrusion member 10 is stopped is specified by the contact portion 12 colliding against a rear end surface of the rear projection 33.

By rotating the rotation thumb 32, the fore stopper moving member 30 meshing with the nozzle-side main body 42 can be moved forwards or rearwards so that the position where the advance of the extrusion member 10 is stopped is set to the desired position.

The other construction is similar to that in the device of Embodiment 1.

In the device of this embodiment, the distance through which the collision member 20 is moved from the state where the rear end of the piston 24 of the collision member 20 is in contact with the inner wall surface of the piston chamber 19 on the rearward side thereof and the extrusion member 10 is in contact with the rear stopper 27 until coming into the state where the fore end of the collision portion 22 contacts with the rear end of the contact portion 12 is set to be longer than the distance through which the extrusion member 10 is moved from the state where the fore end of the collision portion 22 contacts with the rear end of the contact portion 12 to the state where the fore end of the contact portion 12 contacts with the rear end of the rear projection 33. In other words, the distance of movement of the collision member 20 is set to be longer than the distance of movement of the extrusion member 10, which is specified by advanced position specifying means and retracted position specifying means.

Operation

As in Embodiment 1, the collision member is retracted by supplying air to the forward space of the piston chamber 19, and the forward space of the piston chamber 19 is then communicated with the atmosphere. Responsively, the collision member 20 is quickly advanced by the action of the spring 26, and the front end of the collision portion 22 collides against the rear end of the contact portion 12 of the extrusion member 10, thereby causing the extrusion member 10 to quickly advance. Before the fore end of the plunger 13 comes into contact with the inner wall of the liquid chamber 14, the advancing extrusion member 10 is stopped upon the fore end of the contact portion 12, which represents the forward side of the extrusion member 10 in this case, contacting with the rear end of the rear projection 33 of the fore stopper moving member 30. As a result, a part of the liquid material in the liquid chamber 14 is discharged in the form of the liquid droplet from the discharge opening 7.

With the device of this embodiment, the position where the advance of the extrusion member 10 is stopped can be set to such a position that the fore end of the plunger 13 does not contact with the inner wall surface of the liquid chamber 14. The arrangement holding the fore end of the plunger 13 and the inner wall surface of the liquid chamber 14 in a non-contact state is advantageous in that, when the liquid material contains fine particles or the likes, the liquid material can be prevented from becoming undesired with some of the fine particles being pressed and collapsed between the fore end of the plunger 13 and the inner wall of the liquid chamber 14.

Embodiment 4

Construction

A device of Embodiment 4 differs from the devices of the other embodiments in that the rear stopper 27 is disposed midway and the extrusion member 10 does not penetrate through the collision member 20.

Figure 6:
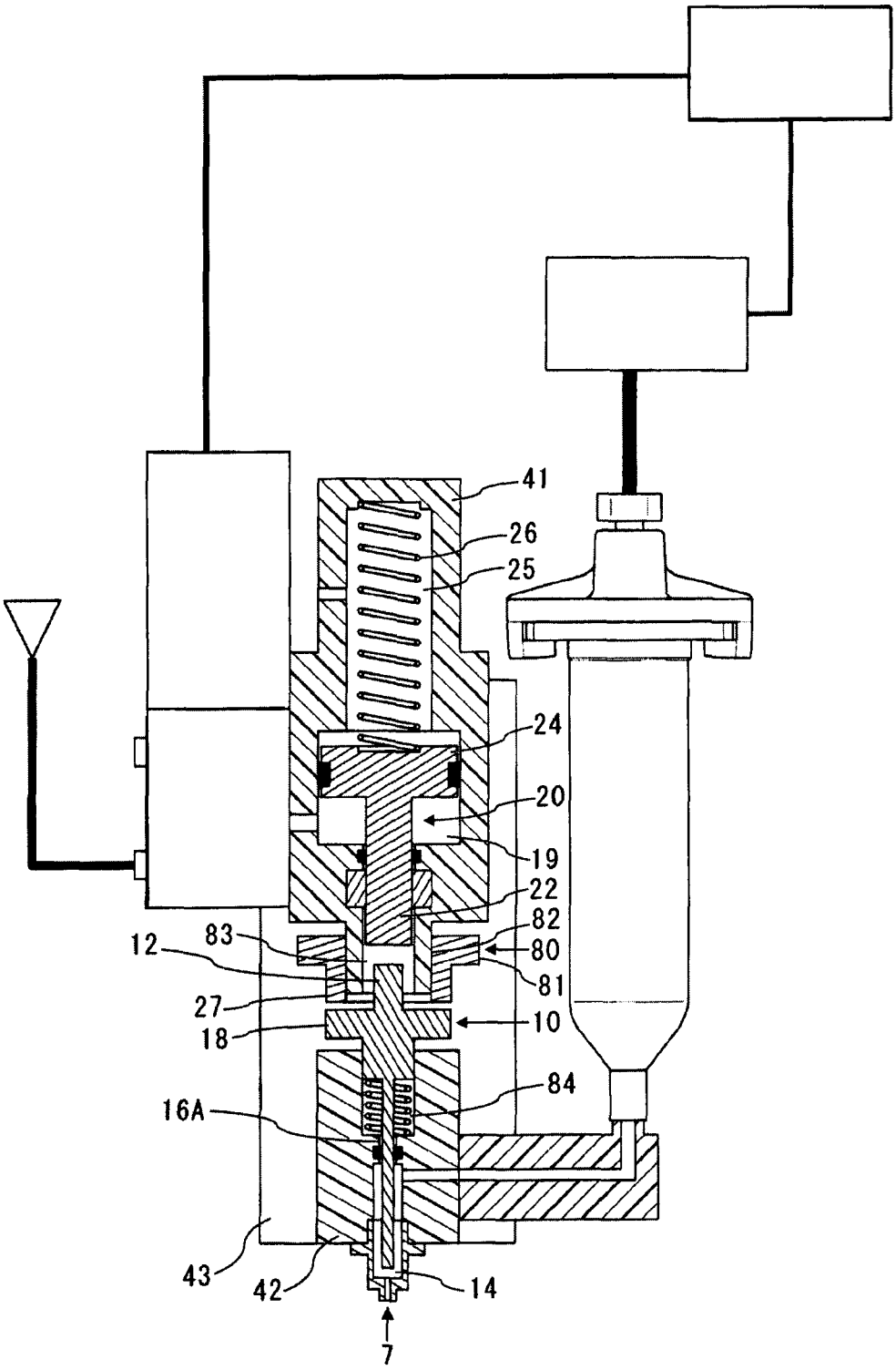
FIG. 6 represents an external appearance view and a sectional view of principal part of a liquid material discharge device according to Embodiment 4.

As illustrated in FIG. 6, the device of this embodiment is featured in comprising a driver-side main body 41, a nozzle-side main body 42, and a rear stopper moving member 80 positioned between them.

The driver-side main body 41 includes a driver-side cylinder 83, the piston chamber 19, and the spring chamber 25, whereas the nozzle-side main body 42 includes a nozzle-side cylinder 84, the liquid chamber 14, and the through-hole 16A. The driver-side main body 41 and the nozzle-side main body 42 are fixed to a base plate 43 such that the relative positional relationship between them is not changed.

The rear stopper moving member 80 comprises a disk-shaped rotation thumb 81, and a rear stopper 27 disposed forward of the rotation thumb 81. Further, a through-hole 82 having threads formed on its inner periphery is formed so as to penetrate through the rear stopper moving member 80 from a rear end of the rotation thumb 81 to a fore end of the rear stopper 27.

The driver-side cylinder 83 has a forward portion formed in a cylindrical shape and having threads formed on its outer circumferential surface. The forward portion of the driver-side cylinder 83 is screwed into the through-hole 82 of the rear stopper moving member.

The extrusion member 10 has a rearward end portion projecting from the nozzle-side main body 42, and a large-diameter rear contact member 18 is fixed to the rearward end portion of the extrusion member 10. A small-diameter contact portion 12 is fixed to a rear end surface of the rear contact member 18.

The collision member 20 is constituted by the piston 24 and the collision portion 22 as in Embodiment 1. However, the collision member 20 does not have the through-hole 16B formed in Embodiment 1.

Further, because the rear stopper moving member 80 is disposed midway, the rear stopper 27 and the micrometer 28 are not provided rearward of the spring chamber 25. The other construction is similar to that in the device of Embodiment 1.

Operation

As in Embodiment 1, the collision member 20 is retracted by supplying air to the forward space of the piston chamber 19, and the forward space of the piston chamber 19 is then communicated with the atmosphere. Responsively, the collision member 20 is quickly advanced by the action of the spring 26, and the front end of the collision portion 22 collides against the rear end of the contact portion 12 of the extrusion member 10, thereby causing the extrusion member 10 to quickly advance. The extrusion member 10 is stopped upon the fore end of the plunger 13 coming into contact with the inner wall of the liquid chamber 14. As a result, a part of the liquid material in the liquid chamber 14 is discharged in the form of the liquid droplet from the discharge opening 7.

In the device of this embodiment, the retraction of the extrusion member 10 is specified by the rear the contact portion 18 coming into contact with the rear stopper 27 positioned midway the device. The position of the rear stopper 27 in the back-and-forth direction can be changed by rotating the rotation thumb 81, whereby the retracted position of the extrusion member 10 to be specified can be changed.

INDUSTRIAL APPLICABILITY

The liquid material discharge device and method according to the present invention are suitable to perform the operation of discharging a very small amount of liquid material with high accuracy. For example, the liquid material discharge device and method can be suitably employed in operations for applying the liquid material to various targets in processes of manufacturing electrical parts, such as semiconductors, and mechanical parts.

More specifically, the liquid material discharge device and method can be suitably employed in operations of applying a very small amount of conductive material, such as a silver paste, in processes of manufacturing electrical parts, applying grease to sliding portions of mechanical parts, such as motors, and applying an adhesive, such as an epoxy resin, to a very small bonding area for bonding of various members, as well as operations for underfilling to fill the liquid material into a gap between a chip and a substrate and for sealing to cover an upper surface of a chip in semiconductor manufacturing processes.

Application fields of the present invention are not limited to the above-described examples, and the present invention can also be suitably employed in applying the liquid material to a very small area that cannot be accessed by a nozzle. In addition, since the liquid material can be applied without changing the distance between the nozzle and the target, the present invention can be further suitably employed in successively applying the liquid material to plural locations.

The invention claimed is:

1. A liquid material discharge device comprising:

a liquid chamber having a discharge opening through which a liquid material is discharged, an extrusion member having a plunger and a contact portion, the plunger being thinner than the liquid chamber not to contact a side wall of the liquid chamber and having a forward end portion which advances and retracts within the liquid chamber, a collision member disposed adjacent to the extrusion member on the side opposite to the plunger and having a piston and a collision portion facing the contact portion, and driving mechanism for advancing and retracting the extrusion member and the collision member, wherein the collision portion is collided against the contact portion such that the extrusion member is advanced to discharge the liquid material.

2. The liquid material discharge device according to claim 1, wherein a distance through which the collision member is moved until the collision portion collides against the contact portion is set to be longer than a distance through which the extrusion member is moved until reaching a foremost advanced position thereof after the collision portion has collided against the contact portion.

3. The liquid material discharge device according to claim 1 or 2, wherein the driving mechanism includes a resilient member for biasing the collision member in an advancing direction.

4. The liquid material discharge device according to claim 1 or 2, further comprising retracted position specifying mechanism for specifying a rearmost retracted position of the extrusion member.

5. The liquid material discharge device according to claim 4, wherein the retracted position specifying mechanism comprises a rear stopper for specifying a position of the extrusion member in a retracting direction of the extrusion member, and extrusion member biasing mechanism for biasing the extrusion member rearwards.

6. The liquid material discharge device according to claim 1 or 2, further comprising advanced position specifying mechanism for specifying a foremost advanced position of the extrusion member.

7. The liquid material discharge device according to claim 6, wherein the advanced position specifying mechanism is constituted by an advance stopper with which the extrusion member comes into contact at a forward side thereof.

8. The liquid material discharge device according to claim 6, wherein the advanced position specifying mechanism is constituted by an inner wall of the liquid chamber, the inner wall being located at a position toward which the forward end portion of the plunger advances.

9. The liquid material discharge device according to claim 6, wherein, when the liquid material is not discharged, the extrusion member is pressed by the collision member and the extrusion member is held at the foremost advanced position thereof.

10. The liquid material discharge device according to claim 8, wherein the forward end portion of the plunger is formed to be able to cut off communication between the liquid chamber and the discharge opening.

11. The liquid material discharge device according to claim 9, wherein the forward end portion of the plunger is formed to be able to cut off communication between the liquid chamber and the discharge opening.

12. The liquid material discharge device according to claim 1 or 2, wherein the driving mechanism includes an air supply device and a solenoid selector valve, and the extrusion member is biased in a retracting direction by air.

13. A liquid droplet discharge method for discharging a part of a liquid material in a liquid chamber in a state of a liquid droplet from a discharge opening by advancing an extrusion member at a high speed, the method comprising:

a step of arranging the liquid chamber having the discharge opening through which the liquid material is discharged, the extrusion member having a plunger and a contact portion, the plunger being thinner than the liquid chamber not to contact a side wall of the liquid chamber and having a forward end portion which advances and retracts within the liquid chamber, and a collision member disposed adjacent to the extrusion member on the side opposite to the plunger and having a piston and a collision portion facing the contact portion, and a step of colliding the collision portion against the contact portion such that the extrusion member is advanced to discharge the liquid material.

14. The liquid material discharge method according to claim 13, wherein a distance through which the collision member is moved until the collision portion collides against the contact portion is set to be longer than a distance through which the extrusion member is moved until reaching a foremost advanced position thereof after the collision portion has collided against the contact portion.

15. The liquid material discharge method according to claim 13 or 14, wherein a standby position of the extrusion member is held the same for each discharge when the collision portion collides against the contact portion.

16. The liquid material discharge method according to claim 13 or 14, wherein a foremost advanced position of the extrusion member is held the same for each discharge.

17. The liquid material discharge method according to claim 13 or 14, wherein the collision portion is collided against the contact portion in a state of the collision member being accelerated.

18. The liquid material discharge method according to claim 13 or 14, wherein the extrusion member is biased in a retracting direction such that, after end of the discharge, the collision member and the extrusion member are retracted in a state that the contact portion and the collision portion are in contact with each other.

19. The liquid material discharge method according to claim 13 or 14, wherein the collision member is biased in an advancing direction such that, when the liquid material is not discharged, the collision member presses the extrusion member to maintain the extrusion member at a foremost advanced position thereof, thereby preventing the liquid material from leaking through the discharge opening.

* * * * *

UNITED STATES PATENT AND TRADEMARK OFFICE

CERTIFICATE OF CORRECTION

PATENT NO. : 8,448,818 B2
APPLICATION NO. : 12/594115
DATED : May 28, 2013
INVENTOR(S) : Kazumasa Ikushima It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 779 days.

Signed and Sealed this
Eighth Day of September, 2015

Michelle K. Lee

Michelle K. Lee
*Director of the United States Patent and Trademark Office*